US005211529A

United States Patent [19]

Esala et al.

[11] Patent Number: 5,211,529

[45] Date of Patent: May 18, 1993

[54] HORIZONTAL STAGING HOPPER

[75] Inventors: David A. Esala, Alexandria, Minn.; Michael J. Johnson, Spokane, Wash.

[73] Assignee: R. A. Pearson Company, Spokane, Wash.

[21] Appl. No.: 859,026

[22] Filed: Mar. 27, 1992

[51] Int. Cl.[5] ..... B65G 57/01

[52] U.S. Cl. ..... 414/795.8; 271/31.1; 271/150; 271/157

[58] Field of Search ..... 414/795.8; 271/31.1, 271/150, 151, 157, 3.1

[56] References Cited

U.S. PATENT DOCUMENTS

| | | | |
|---|---|---|---|
| 2,161,124 | 6/1939 | Babicz | 271/149 |
| 3,391,806 | 7/1968 | Geis et al. | 414/798.9 |
| 3,598,399 | 10/1971 | Cottrell | 271/62 |
| 4,697,973 | 10/1987 | Hahn et al. | 414/330 |
| 4,708,568 | 11/1987 | Odorici | 414/330 |
| 4,919,589 | 4/1990 | Krappitz | 414/795.8 X |
| 4,934,682 | 6/1990 | Rece et al. | 271/3.1 |
| 5,131,899 | 7/1992 | Nagahashi | 271/31.1 X |
| 5,161,792 | 11/1992 | Wood | 271/31.1 X |

*Primary Examiner*—Richard A. Schacher

*Attorney, Agent, or Firm*—Wells, St. John, Roberts, Gregory & Matkin

[57] ABSTRACT

A staging hopper for supplying packaging blanks includes a first conveyor positioned downstream of a second conveyor. The first conveyor supports and periodically transfers packaging blanks in a primary group of blanks to a blank delivery position. A second conveyor supports and intermittently transfers packaging blanks in a secondary group of blanks onto the first conveyor. The top edges of the secondary group of blanks rest at an angle against the primary group of blanks to define a longitudinal gap between the lower edges of the blanks in the primary and secondary groups. Photosensors are provided to detect the presence and absence of packaging blanks within the longitudinal gap. In addition to advancing the primary group of blanks, the first conveyor advances the forward blanks in the secondary group across the gap toward the primary group. The photosensors detect the presence of these blanks as their lower edges move across the gap. Upon failure to detect any packaging blanks within the gap, the photosensors activate the second conveyor to move successive forward blanks in the secondary group onto the first conveyor.

13 Claims, 5 Drawing Sheets

FIG. II
10
72
57
30
59
34
18
16
64
62
66
74
78
80
56
41
76
82
40
43
32

HORIZONTAL STAGING HOPPER

TECHNICAL FIELD

This invention relates to horizontal hoppers for packaging machinery and, more particularly, to staging hoppers for primary and secondary groups of packaging blanks.

BACKGROUND OF THE INVENTION

Horizontal hoppers are used to provide a continuous supply of cartons, boxes, cardboard ribs, or other packaging blanks to operational packaging machinery. Typically, such hoppers support an array of folded packaging blanks in a predetermined orientation. Lead packaging blanks are removed periodically from the array by movable vacuum arms or the like which transfer the lead blank to an assembly conveyor where subsequent operations are carried out on the blanks. The hopper must insure that a new blank is in proper position for removal by the vacuum transfer mechanism during each blank delivery cycle. Additionally, the hopper should have sufficient capacity to support a large number of packaging blanks so that the hopper does not need to be frequently reloaded.

Two design considerations in hoppers are that the hopper (1) support a large number of packaging blanks and (2) maintain the lead packaging blank at its proper delivery position. Oftentimes, the designs of horizontal hoppers has compromised one of these design considerations to satisfy the other. In hoppers with a large capacity, the leaning weight of a large horizontal array of packaging blanks typically applies undesired and varying pressure to the lead packaging blank. This pressure causes delivery errors. On the other hand, hoppers which maintain the lead packaging blank at its proper delivery position without undue pressure offer small capacity storage. This requires frequent reloading.

A third design consideration in such hoppers is the desire to make the supply of packaging blanks continuous relative to operation of the associated packaging machinery. Accordingly, a hopper should be designed to facilitate reloading of packaging blanks without affecting or halting the desired continuous feed operation.

U.S. Pat. No. 4,934,682 to Rece discloses an apparatus for feeding cartons which divides the array of cartons into two groups. The first group of cartons is advanced on a first feed conveyor to a delivery position so that lead cartons can be successively delivered for assembly. A second, larger group of cartons is supported and transferred on a second feed conveyor against an inclined stop in a position above the first conveyor and first group of cartons. A downward ramp separates the two conveyors and two groups of cartons. A sensor is employed to detect when the number of cartons in the first group diminishes to a predetermined level. Upon reaching this predetermined level, the cartons from the second group are transferred down the ramp to the first group of cartons. While the Rece patent disclosure satisfies many of the design considerations of a blank hopper, the Rece hopper requires many structural elements to separate the two groups of cartons, including the downward ramp and the inclined stop. These structural elements complicate operating effectiveness and add to the overall cost of the disclosed staging hopper.

U.S. Pat. No. 4,697,973 to Hahn, U.S. Pat. No. 3,598,399 to Cottrell, U.S. Pat. No. 3,391,806 to Gies, and U.S. Pat. No. 2,161,124 to Babicz disclose apparatuses for feeding folded cartons. These patents, like the Rece patent, describe staging hoppers which require additional structural elements for separating two groups of cartons.

The present invention accomplishes all of the design goals for staging hoppers while minimizing the structural components and cost of the hopper.

BRIEF DESCRIPTION OF THE DRAWINGS

Preferred embodiments of the invention are described below with reference to the accompanying drawings, which are briefly described below.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
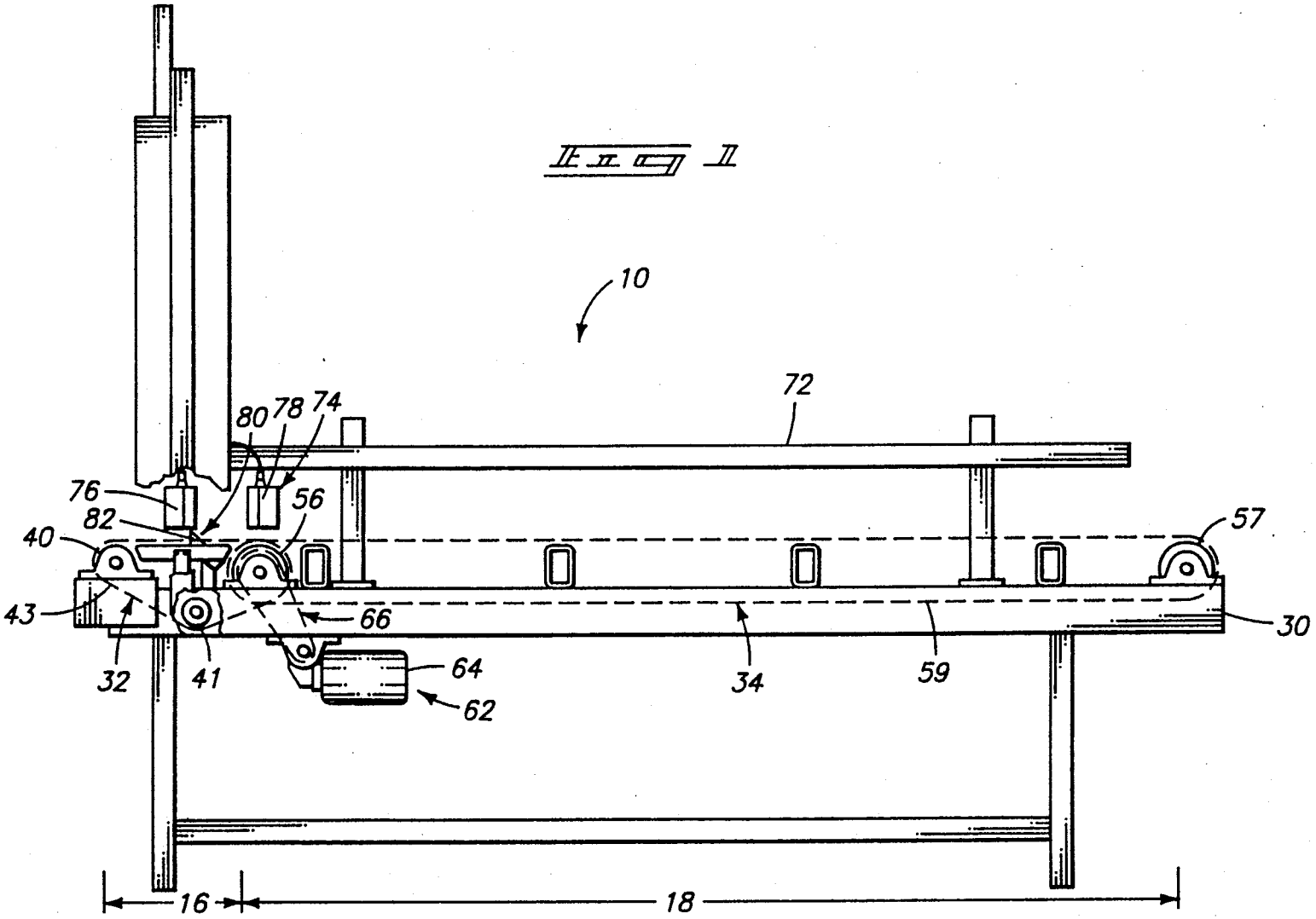
FIG. 1 is a side elevation view of a staging hopper according to the present invention.
Figure 2:
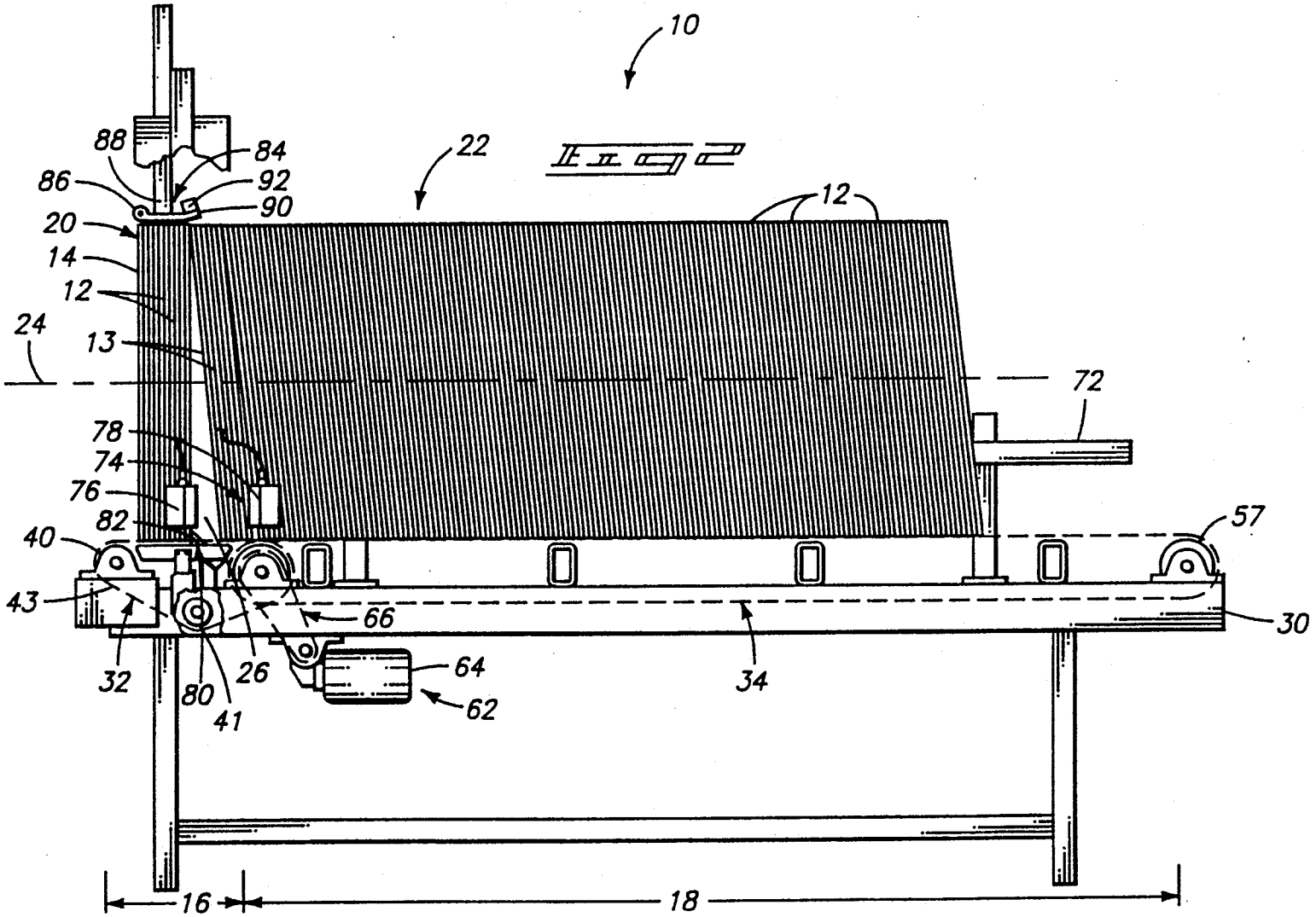
FIG. 2 is a side elevation view of the staging hopper shown in FIG. 1 with an array of packaging blanks supported thereon.

FIGS. 1 and 2 show a staging hopper 10 for supplying packaging blanks 12 for packaging machinery. The term "packaging blanks" is intended to include boxes, cartons, inserts, ribbing, dividers, and other packaging components.

Staging hopper 10 is a horizontal supply hopper designed to hold an array of packaging blanks and to advance them to a blank delivery position. At the blank delivery position, another apparatus (not shown) removes individual lead blanks from staging hopper 10 for further assembly operations. One common apparatus for this purpose is a movable delivery vacuum cup system which engages the lead packaging blank 14 and transfers it from staging hopper 10 to an assembly conveyor or other packaging machinery equipment.

Staging hopper 10 includes a primary hopper 16 and a secondary hopper 18 positioned upstream from primary hopper 16. Primary hopper 16 supports a primary group 20 of upright packaging blanks. Secondary hopper 18 supports a secondary group 22 of upright packaging blanks.

Staging hopper 10 advances primary group 20 of packaging blanks along a feed axis 24 for continuously supplying a packaging blank to the blank delivery position. Staging hopper 10 also continually resupplies primary group 20 with packaging blanks from secondary group 22. The forward packaging blanks (which will be referred to throughout this disclosure by the reference numeral 13) of secondary group 22 are intermittently shifted from secondary group 22 to primary group 20 to provide a continuous supply of packaging blanks to primary group 20 and to the blank delivery position.

Primary hopper 16 preferably supports blanks in primary group 20 at a substantially perpendicular position in relation to feed axis 24 (FIG. 2). In contrast, secondary hopper 18 preferably supports blanks in secondary group 22 at non-perpendicular angles to feed axis 24. In this manner, the top edges of forward blanks 13 of the secondary group 22 lean against primary group 20 to define a longitudinal gap 26 between the lower edges of the blanks in the respective groups 20, 22. Individual blanks 12 within each group 20 and 22 are shown in a close abutting relationship for clarity purposes. In practice, the groups of blanks may be loosely "fanned out" with air gaps between individual adjacent blanks.

Staging hopper 10 includes a frame 30, a first longitudinal conveyor 32 operatively mounted to frame 30, and a second longitudinal conveyor 34 operatively mounted to frame 30 upstream from first conveyor 32. First and second conveyors 32 and 34 provide a continuous and substantially coplanar surface for supporting the packaging blanks in the primary and secondary groups.

First conveyor 32 is located beneath primary hopper 16 to engage the lower edges of packaging blanks 12 in primary group 20. First conveyor 32 advances packaging blanks in primary group 20 along feed axis 24 toward the blank delivery position, where they are individually available for discharge. It also engages the lower edges of the forward packaging blanks 13 in secondary group 22 across gap 26 toward primary group 20, as will be described below in more detail.

Second conveyor 34 is located beneath secondary hopper 18 to engage the lower edges of packaging blanks 12 in the secondary group 22. Secondary conveyor 34 intermittently advances the secondary group 22 of packaging blanks 12 along feed axis 24 toward primary group 20.

Figure 3:
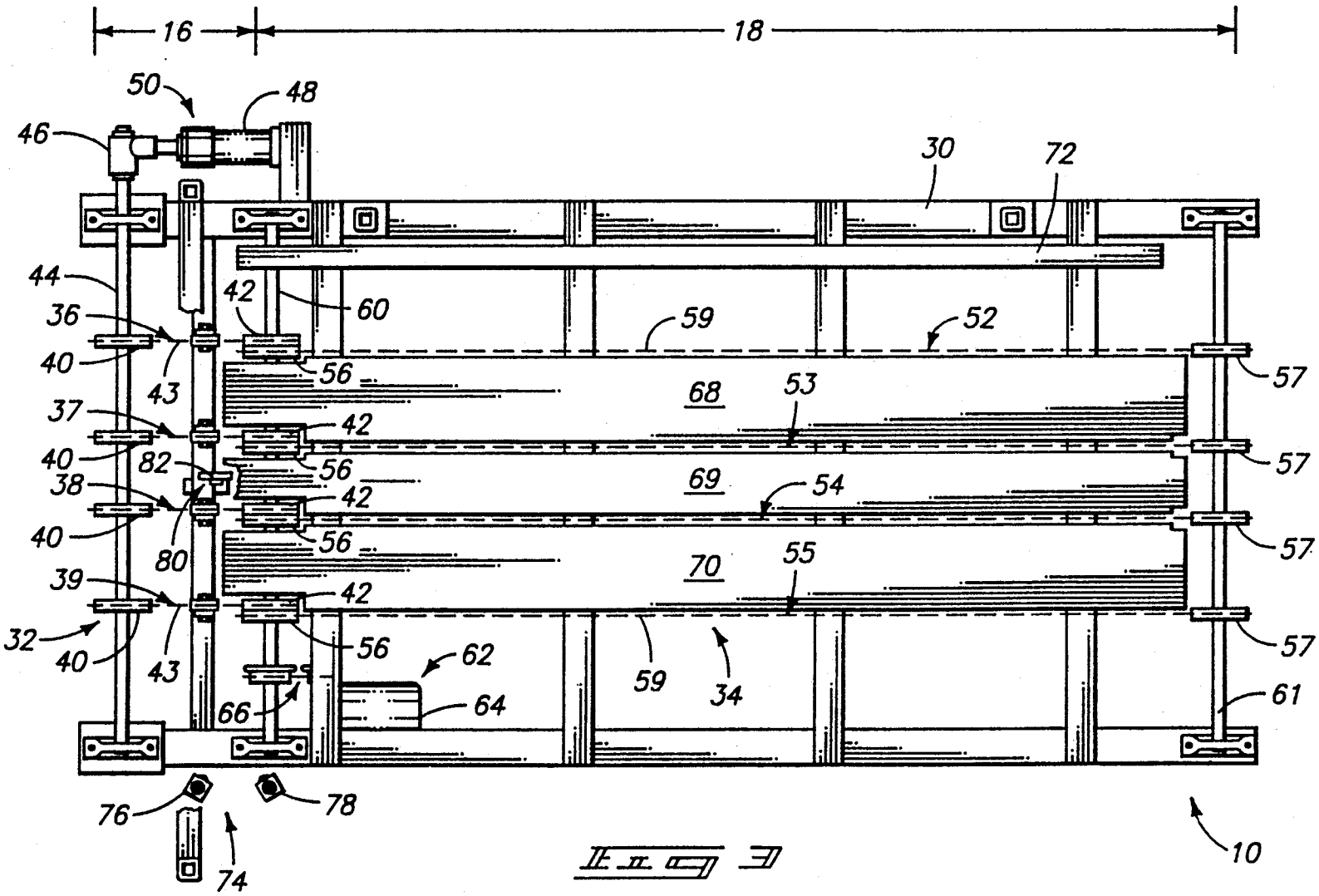
FIG. 3 is a top plan view of the staging hopper of the present invention.

First and second conveyors 32 and 34 and the means for driving these conveyors will now be described with reference to FIGS. 1-3. First conveyor 32 includes four chain and sprocket drives 36-39. Each chain and sprocket drive includes a chain looped around three sprockets, as represented by chains 43 and sprockets 40, 41 and 42. Sprockets 40 are fixed at spaced intervals to drive shaft 44 (FIG. 3). Sprockets 41 are preferably tensioners, but can be idlers rotatably mounted to frame 30. Sprockets 42 are preferably idlers. Primary group 20 of packaging blanks 12 are supported on, and conveyed by, chains 43 in chain and sprocket drives 36-39 of first conveyor 32.

Second conveyor 34 includes four chain and sprocket drives 52-55. Each chain and sprocket drive in second conveyor 34 comprises a chain and two sprockets, as represented by chains 59 and sprockets 56 and 57. Sprockets 56 are fixed at spaced intervals to a drive shaft 60. Sprockets 57 are preferably idlers which are rotatably mounted to cross shaft 61. Secondary group 22 of packaging blanks 12 is supported on, and conveyed by, chains 59 in chain and sprocket drives 52-55 of second conveyor 34.

Sprockets 42 of first conveyor 32 and sprockets 56 of second conveyor 34 are preferably coupled to the same drive shaft 60 (FIG. 3). Sprockets 42 are rotatably mounted to drive shaft 60 and, as noted above, sprockets 56 are fixed to drive shaft 60. Staging hopper 10 also has guide plates 68-70 which are mounted to frame 30 between adjacent ones of the chain and sprocket drives 52-55 (FIG. 3) and a guide member 72.

Conveyors 32 and 34 are described and shown in accordance with a preferred embodiment of the invention. However, the invention is not limited to the conveyor design described or shown. Other chain and sprocket arrangements with more or less than four drives may be employed. Further, other conveyor systems may be used, such as belt and pulley or conveyor belts around cylindrical rollers. Additionally, in the preferred embodiment of the hopper, the first and second conveyors share drive shaft 60. In other embodiments, the conveyors may longitudinally overlap in some manner. Alternatively, the conveyors may be separated slightly with a fixed coplanar surface mounted therebetween.

Staging hopper 10 includes first drive means 50 for periodically moving first conveyor 32 as part of a blank delivery cycle in which lead blank 14 is discharged from primary group 20. Drive means 50 advances first conveyor 32 at periodic cycles to continuously supply a new blank to the blank delivery position. These periodic cycles are synchronized with the operation of other packaging machinery. In the preferred embodiment, drive means 50 has a ratchet coupling 46 operatively connected to a cylinder 48. Ratchet coupling 46 is mechanically coupled to drive shaft 44 for driving chain and sprocket drives 36-39 of first conveyor 32.

Staging hopper 10 further comprises a second drive means 62 operatively coupled to drive second conveyor 34 for selectively transferring blanks in secondary group 22 toward primary group 20 on demand. While drive means 62 is advancing second conveyor 34, forward blanks 13 of the secondary group are pushed onto first conveyor 32. In the preferred embodiment, second drive means 62 comprises an electric motor 64 and a chain and sprocket drive 66 which is coupled to drive shaft 60 for driving chain and sprocket drives 52-55 of second conveyor 34.

Figure 4:
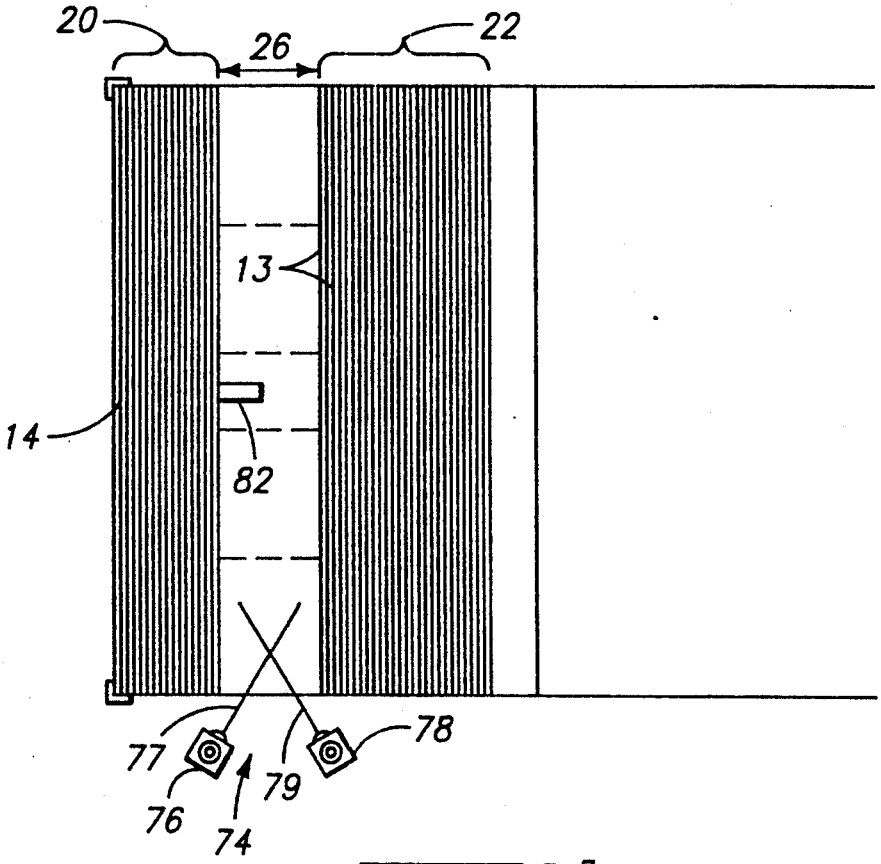
FIG. 4 is a diagrammatical illustration depicting the operation of two photosensors employed in the staging hopper of the present invention.

Staging hopper 10 includes a sensor means 74 for monitoring the presence or absence of a packaging blank 12 within gap 26. With reference to FIGS. 1-4, sensor means 74 includes two photosensors 76 and 78 positioned directly above conveyors 32 and 34 (FIGS. 1-3). Photosensors 76 and 78 are angularly oriented so that their center beam axes 77 and 79 intersect in longitudinal gap 26 (FIG. 4). Particularly, photosensor 76 is angled to detect the side edges of the rear blanks in primary group 20. Photosensor 78 is angled to detect the side edges of forward blanks 13 in secondary group 22.

Sensor means 74 outputs signals to second drive means 62 to control operation of second conveyor 34. When sensor means 74 fails to detect any packaging blanks in gap 26, second conveyor 34 is activated to advance the blanks in secondary group 22. Specifically, second conveyor 34 is activated any time both photosensors 76 and 78 fail to detect a blank in gap 26. Preferably, the second conveyor continues to operate and transfer the secondary group of blanks until either photosensor detects the presence of a blank within gap 26. Photosensor 78 is usually first to detect the next forward packaging blanks as they are pushed onto first conveyor 32. Photosensor 78 then outputs a signal to halt operation of second drive means 62 and second conveyor 34. In an alternative embodiment, the second conveyor is operated for a preselected time period after it has been activated by sensor means 74 independent of whether the photosensors detect blanks.

Staging hopper 10 has a gate means 80 positioned in the path of packaging blanks in primary group 20. Gate means 80 allows blanks to be longitudinally advanced from the secondary group to the primary group, but prevents blanks from sliding back toward the secondary group. Gate means 80 is preferably positioned approximately midway of first conveyor 32 between chain and sprocket drives 37 and 38 (FIG. 3).

In the preferred embodiment, gate means 80 includes a rotatable member 82 that is mechanically biased to project upwardly as shown in FIGS. 1 and 2 and a weighted friction guide 84 positioned atop primary group 20. The mechanical bias of member 82 can be overcome by a force applied by friction guide 84 to passing packaging blanks as the blanks are transferred from secondary group 22 to primary group 20. That is, as a packaging blank is transferred across gap 26, friction guide 84 applies a downward force on the blank as it passes over member 82. Member 82 rotates in a counterclockwise direction (as viewed in FIGS. 1–2) to allow the packaging blank to slide into primary group 20, and then rotates back in a clockwise direction to prevent the packaging blank from sliding longitudinally backwards toward secondary group 22. Preferably, friction guide 84 is pivotally mounted about pivot 86 to vertical bar 88, which is fixedly mounted to frame 30. Friction guide 84 includes a "ski-like" member 90 with a weight 92 mounted to the tip of member 90 opposite pivot 86.

Figure 5:
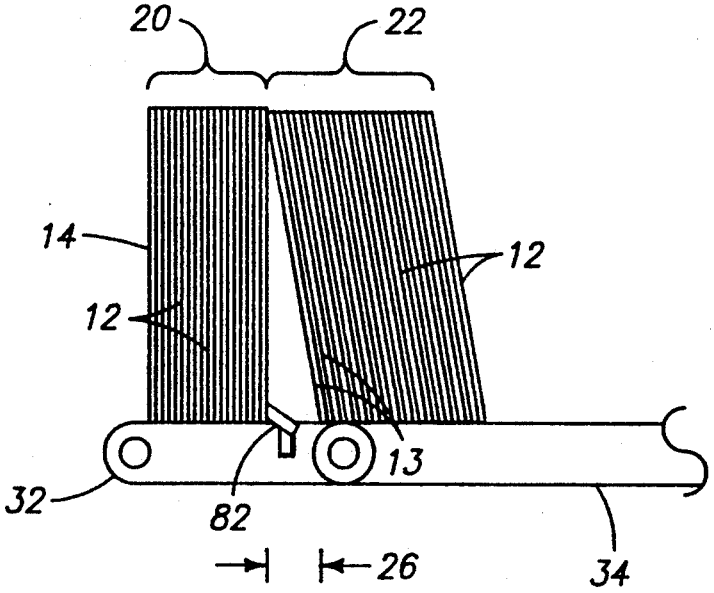
FIGS. 5-8 diagrammatically illustrate the operation of the staging hopper of the present invention.

The operation of staging hopper 10 will now be described with reference to FIGS. 5–8. In FIG. 5, primary and secondary groups 20 and 22 of packaging blanks are being supported on first and second conveyors 32 and 34, respectively. Top edges of lead packaging blanks 13 in secondary group 22 rest against blanks in primary group 20 to define a longitudinal gap 26 between the lower edges of the blanks. Lower edges of the forward packaging blanks 13 of secondary group 22 engage first conveyor 32.

Figure 6:
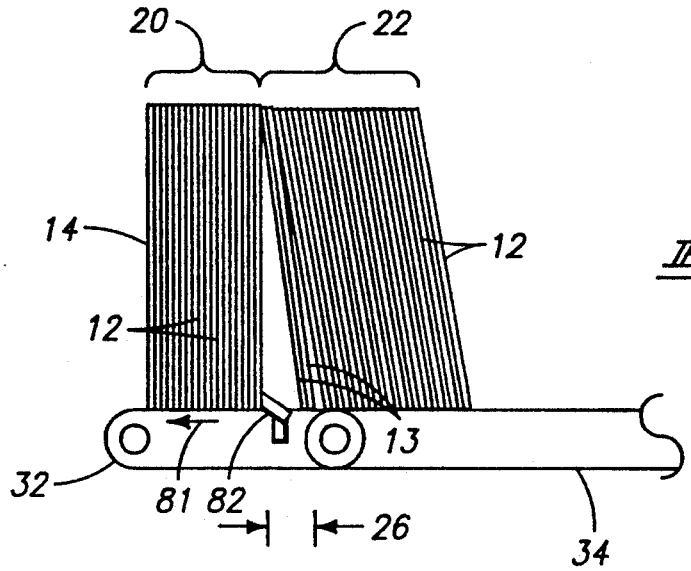

In FIG. 6, first conveyor 32 is advanced by drive means 50 (not) shown) in the direction indicated by the arrow 81 during each delivery blank cycle to systematically move the next packaging blank in primary group 20 to blank the delivery position. First conveyor 32 is advanced each cycle a distance greater than the distance required to advance the next packaging blank to the blank delivery position. In other words, first conveyor 32 moves under blanks 12 in primary group 20 at a linear speed overrunning the rate of discharge of lead packaging blanks 14 in primary group 20.

First conveyor 32 also moves the lower edges of forward packaging blanks 13 of secondary group 22 across gap 26. During this time, one or both photosensors 76 and 78 of sensor means 74 detect the presence of forward packaging blanks 13 as their lower edges traverse across gap 26. To fully transfer the lower edges of forward packaging blanks 13 across gap 26, first conveyor 32 may be advanced several times. In FIG. 6, only two packaging blanks 13 are shown traversing across gap 26 for illustration purposes. In practice, more than two blanks typically migrate simultaneously across the gap.

Figure 7:
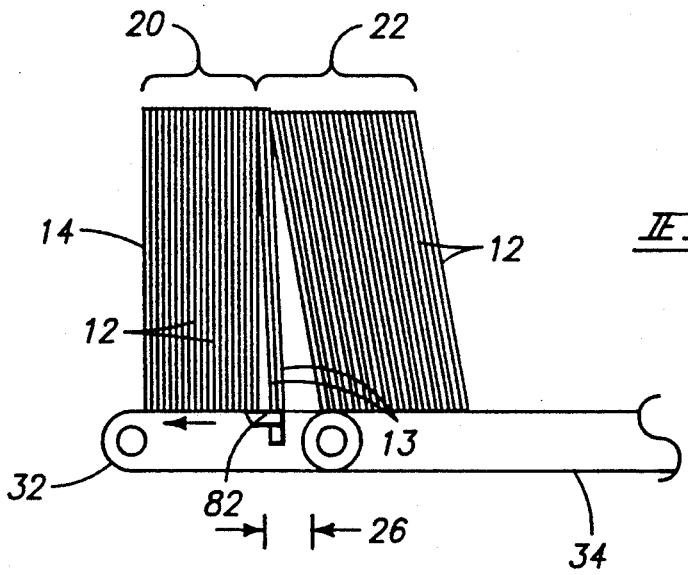

In FIG. 7, the moving forward packaging blanks 13 are shown at positions substantially across gap 26. Blanks 13 displace member 82 to its horizontal position as they are added to the rear of primary group 20. At approximately this point in the operation of staging hopper 10, both photosensors 76 and 78 of sensor means 74 will no longer detect any packaging blanks within gap 26. As a result, sensor means 74 outputs control signals to activate second conveyor 34.

Figure 8:
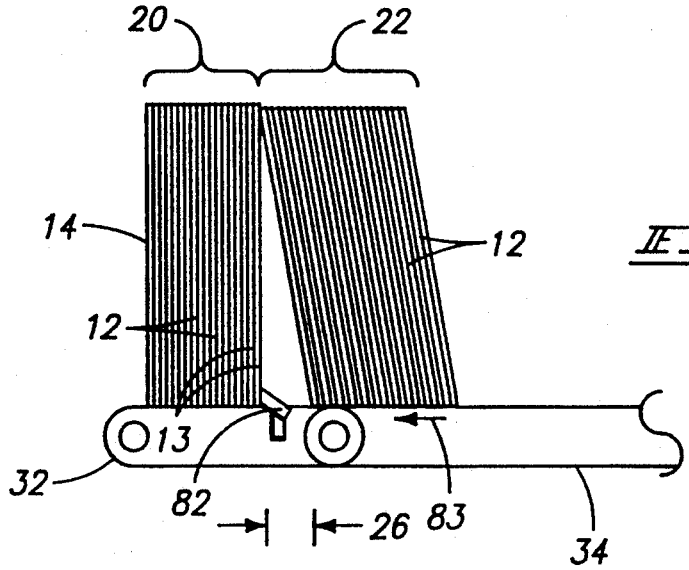

In FIG. 8, second conveyor 34 is advanced by drive means 62 in the direction indicated by the arrow 83 to move the next forward packaging blanks of secondary group 22 onto first conveyor 32. Second conveyor 34 preferably continues to operate until one or both photosensors 76 and 78 detect a blank in gap 26. Alternatively, the second conveyor may operate for a preselected time period. Typically, two to six forward packaging blanks 13 are transferred onto first conveyor 32 before the second conveyor is halted.

Meanwhile, first conveyor 32 continues to periodically advance primary group 20 during each blank delivery cycle. As a result, incoming packaging blanks 13 are added to the rear of primary group 20 and member 82 is permitted to rotate back to its non-horizontal position to insure that packaging blanks 13 remain in vertical positions and do not slide back toward secondary group 22.

The operation of first conveyor 32 is preferably independent of the operation of second conveyor 34. Its operation is synchronized with the operation of other packaging machinery. On the other hand, the second conveyor is operated on demand to supply more blanks to the primary group of blanks.

The present invention is advantageous over prior art staging hoppers in that a large number of packaging blanks may be supported on and conveyed by the staging hopper without applying significant varying pressure to lead packaging blanks at the blank delivery position. The staging hopper provides a continuous supply of packaging blanks in an efficient manner while facilitating easy and less frequent reloading. Additionally, unlike prior art hoppers, the staging hopper of the present invention does not require any special mechanical structures or mechanisms for separating and holding the secondary group of packaging blanks from the primary group. Instead, the top edges of the forward blanks in the large secondary group of packaging blanks simply rest against the primary group of packaging blanks without applying any significant changing pressure to the packaging blanks in the primary group.

In compliance with the statute, the invention has been described in language more or less specific as to structural and methodical features. The invention is not, however, limited to the specific features shown or described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A staging hopper for packaging blanks, comprising:

a first longitudinal conveyor engaging a plurality of transverse blanks across their lower edges within a primary group of upright blanks having a lead blank available for discharge at a blank delivery position;

a second longitudinal conveyor leading to the first conveyor and engaging a plurality of transverse blanks across their lower edges within a secondary group of upright blanks, the top edges of the forward blanks in the secondary group of blanks resting at an angle against the primary group of blanks;

first drive means for periodically moving the first conveyor as part of a blank delivery cycle in which a lead blank is discharged from the primary group of blanks, the first conveyor being moved under the primary group of blanks at a linear speed overrunning the rate of discharge of lead blanks at the blank delivery position to advance individual blanks in the primary group successively to the blank delivery position and to longitudinally transfer forward blanks in the secondary group to the primary group;

second drive means operably connected to drive the second conveyor for selectively transferring forward blanks of the secondary group onto the first conveyor; and sensor means directed across a predetermined longitudinal gap separating the lower edges of blanks in the primary and secondary groups at an elevational location above the first conveyor for intermittently operating the second drive means in response to the absence of blanks within the gap.

2. The staging hopper according to claim 1 wherein the sensor means terminates operation of the second drive means in response to detection of a blank within the gap.

3. The staging hopper according to claim 1 wherein the second drive means drives the second conveyor for a preselected time period after operation in initiated by the sensor means.

4. The staging hopper according to claim 1 further comprising:

gate means positioned in the path of the primary group of blanks for allowing blanks to be longitudinally advanced by the first conveyor away from the secondary group of blanks toward the blank delivery position and preventing blanks from moving longitudinally backwards toward the secondary group of blanks.

5. The staging hopper according to claim 1 wherein the sensor means comprises first and second photosensors oriented so that their center beam axes intersect in the longitudinal gap.

6. The staging hopper according to claim 1 wherein the first drive means comprises:

a ratchet coupling operatively connected to the first conveyor; and a cylinder coupled to drive the ratchet coupling and advance the first conveyor a predetermined distance each delivery cycle.

7. A staging hopper for packaging blanks, comprising:

a primary hopper for supporting a plurality of transverse blanks in a primary group of blanks arranged in upright positions substantially perpendicular to a feed axis;

a secondary hopper positioned upstream from the primary hopper for supporting a plurality of transverse blanks in a secondary group of blanks with top edges of forward blanks of the secondary group of blanks leaning against the primary group of blanks at non-perpendicular angles to the feed axis to define a longitudinal gap between the lower edges of the primary and secondary groups of blanks;

a first longitudinal conveyor located beneath the primary hopper to engage the blanks of the primary group across their lower edges;

a second longitudinal conveyor located beneath the secondary hopper to engage the blanks of the secondary group across their lower edges;

first drive means for periodically moving the first conveyor to longitudinally advance the primary group of blanks and to longitudinally transfer the lower edges of forward blanks in the secondary group across the gap;

second drive means operably connected to drive the second conveyor for selectively transferring the forward blanks of the secondary group onto the first conveyor; and sensor means directed across the gap at an elevational location above the first conveyor for intermittently operating the second drive means in response to the absence of blanks within the gap.

8. The staging hopper according to claim 7 wherein the sensor means terminates operation of the second drive means in response to detection of a blank within the gap.

9. The staging hopper according to claim 7 wherein the second drive means drives the second conveyor for a preselected time period after operation is initiated by the sensor means.

10. The staging hopper according to claim 7 wherein the primary group has a lead blank at a blank delivery position and a lead blank is discharged each blank delivery cycle; the first conveyor being periodically moved in response to operation of the first drive means by a distance greater than the distance required to advance the next blank in the primary group to the blank delivery position.

11. The staging hopper according to claim 7 further comprising:

gate means positioned in the path of the primary group of blanks for allowing blanks to be longitudinally advanced by the first conveyor away from the secondary group of blanks toward the blank delivery position and preventing blanks from moving longitudinally backwards toward the secondary group of blanks.

12. The staging hopper according to claim 7 wherein the sensor means comprises:

first and second photosensors oriented so that their center beam axes intersect in the longitudinal gap.

13. The staging hopper according to claim 7 wherein the first drive means comprises:

a ratchet coupling operatively connected to the first conveyor; and a cylinder coupled to drive the ratchet coupling and advance the first conveyor a predetermined distance each delivery cycle.

* * * * *